US007594538B2

(12) United States Patent
Stenhede et al.

(10) Patent No.: US 7,594,538 B2
(45) Date of Patent: Sep. 29, 2009

(54) PLATE PACKAGE

(75) Inventors: Claes Stenhede, Verona (IT); Mats Strömblad, Båstad (SE); Roland Larsson, Malmö (SE)

(73) Assignee: Alfa Laval Corporate AB, Lund (SE)

( * ) Notice: Subject to any disclaimer, the term of this patent is extended or adjusted under 35 U.S.C. 154(b) by 867 days.

(21) Appl. No.: 10/560,705

(22) PCT Filed: Jun. 11, 2004

(86) PCT No.: PCT/SE2004/000921

§ 371 (c)(1),
(2), (4) Date: Dec. 13, 2005

(87) PCT Pub. No.: WO2004/111564

PCT Pub. Date: Dec. 23, 2004

(65) Prior Publication Data

US 2006/0191672 A1 Aug. 31, 2006

(30) Foreign Application Priority Data

Jun. 18, 2003 (SE) ..... 0301764

(51) Int. Cl.
*F28D 1/03* (2006.01)
*F28F 3/08* (2006.01)

(52) U.S. Cl. ..... 165/157; 165/145; 165/167

(58) Field of Classification Search ..... 165/145, 165/157, 167
See application file for complete search history.

(56) References Cited

U.S. PATENT DOCUMENTS 3,106,243 A * 10/1963 Knudsen ..... 165/167
3,117,624 A * 1/1964 Wennerberg ..... 165/167
3,538,718 A 11/1970 Karbosky
4,162,703 A * 7/1979 Bosaeus ..... 165/167
4,219,079 A * 8/1980 Sumitomo ..... 165/167
4,219,080 A * 8/1980 Chaix et al. ..... 165/145
4,749,032 A * 6/1988 Rosman et al. ..... 165/167

(Continued)

FOREIGN PATENT DOCUMENTS

EP 0 758 073 B1 2/1997

(Continued)

*Primary Examiner*—Leonard R Leo
(74) *Attorney, Agent, or Firm*—Fish & Richardson P.C.

(57) ABSTRACT

The invention relates to a plate package for a heat exchanger device including a tank with an inner space and an inner wall surface. A sectional plane (p) extends vertically through the inner space. The tank has an inlet for the supply of a liquid medium and an outlet for discharging the medium in a gaseous state. The inner space defines a lower part space and an upper part space. The plate package (10) with heat exchanger plates (11) is provided in the inner space. Each heat exchanger plate has an extension plane perpendicular to the sectional plane. The heat exchanger plates form first plate interspaces that are open towards the inner space for recirculation of the medium, and second plate interspaces, which are closed towards the inner space for the recirculation of a fluid for evaporating the medium. Each heat exchanger plate includes a first porthole (14) and a second porthole (15). Furthermore, each heat exchanger plate includes an elongated distribution element (25) which extends into the adjacent second plate interspace and substantially transversally to the sectional plane (p).

18 Claims, 4 Drawing Sheets

U.S. PATENT DOCUMENTS

| | | | | | |
|---|---|---|---|---|---|
| 4,763,488 | A | * | 8/1988 | Johnston | 165/167 |
| 5,203,406 | A | * | 4/1993 | Blomgren et al. | 165/167 |
| 5,509,471 | A | * | 4/1996 | Hallgren | 165/167 |
| 6,158,238 | A | | 12/2000 | Lampinen et al. | |

FOREIGN PATENT DOCUMENTS

| | | |
|---|---|---|
| WO | WO97/45689 | 12/1997 |
| WO | WO03/060411 | 7/2003 |

* cited by examiner

PLATE PACKAGE

THE BACKGROUND OF THE INVENTION AND PRIOR ART

The present invention refers to a plate package for a heat exchanger device including a tank, which forms a substantially closed inner space and which includes an inner wall surface facing the inner space, wherein the tank is arranged to be provided in such a way that a sectional plane, which extends through the plate package and the inner space of the tank, is substantially vertical, wherein the plate package is arranged to be provided in the inner space and includes heat exchanger plates provided adjacent to each other, wherein each heat exchanger plate has a main extension plane and is provided in such a way that the extension plane is substantially perpendicular to said sectional plane, wherein the heat exchanger plates form first plate interspaces, which are substantially open to the inner space and arranged to permit circulation of said medium from the lower part space upwardly to the upper part space, and second plate interspaces, which are closed to the inner space and arranged to permit recirculation of a fluid for evaporating the medium, wherein the first plate interspaces in an upper portion of the plate package form outlet channels for the medium, wherein each heat exchanger plate includes a first porthole and a second porthole and wherein the first portholes form an inlet channel for said fluid to the second plate interspaces and the second portholes form an outlet channel for said fluid from the second plate interspaces.

It is known to use such plate packages in heat exchanger devices for evaporating various cooling medium such as ammonium, freons etc, in applications for generating cold, for instance. The evaporated medium is then conveyed from heat exchanger device to a compressor and the compressed gaseous medium is thereafter condensed in a condenser. Thereafter the medium is permitted to expand and is then recirculated to the heat exchanger device. In such applications, it is important that the evaporation is complete and that no liquid is still present in the medium when it is supplied to the compressor, since the latter then may be damaged. In order to solve this problem, it is known to provide a liquid separator in the heat exchanger device in the proximity of the outlet for the medium. Such a liquid separator is disclosed in EP-B1-758 073, for instance.

This document discloses a heat exchanger device including a tank, which forms a substantially closed inner space and which has an inner wall surface facing the inner space. The tank includes an inlet for the supply of a medium in a liquid state and an outlet for discharging the medium in a gaseous state. The inner space defines a first lower part space for the medium in the liquid state and a second upper part space for the medium in the gaseous state. A plate package is provided in the inner space and includes heat exchanger plates provided against to each other. The heat exchanger plates form first plate interspace, which are open towards the inner space and arranged to permit recirculation of said medium from the first space upwardly towards the second space, and second plate interspaces, which are closed towards the inner space and arranged to permit recirculation of a fluid for evaporating the medium. The first plate interspaces form channels for said medium, which extend substantially straight upwardly along their whole length. Above plate package, a liquid separator is provided in such a way that substantially the whole quantity of the medium flowing upwardly from the plate package will hit the liquid separator and flow through the same, wherein possible remaining liquid is caught by the liquid separator and recirculated to the first lower part space.

WO97/45689 discloses an example of another heat exchanger device for an evaporator. The heat exchanger device includes a tank housing a plate package and a liquid separator in an upper part of the tank.

The disadvantage of such separate liquid separators is that they require space in the heat exchanger device. Such separators also increase the complexity and thus result in higher costs for manufacturing the device.

U.S. Pat. No. 3,538,718 discloses another heat exchanger device for cooling a fluid through evaporation of a liquid in a tank. The fluid is conveyed through a heat exchanger which is completely submerged in the liquid present in the tank. When the fluid is cooled, the liquid will be evaporated and the evaporated medium rises upwardly in the tank and is discharged via an outlet conduit. In this document, it is stated that the possible remaining liquid in the evaporated medium will be separated and recirculated to the liquid in the lower part of the tank.

SUMMARY OF THE INVENTION

The object of the present invention is to provide a plate package ensuring an efficient heat transfer and having a compact and simple construction. Furthermore, it is aimed at a plate package with low manufacturing costs.

This object is achieved by means of the plate package initially defined, which is characterised in that each heat exchanger plate includes an elongated distribution element extending into the adjacent second plate interspace and substantially transversally to said sectional plane. Such an elongated distribution element, which extends transversally to the sectional plane, i.e. substantially horizontally, will force the main part of the flow of said fluid to flow outwardly towards the sides and thus to take a longer way between the inlet channel and the outlet channel than if said fluid would flow substantially straight from the inlet channel to the outlet channel. In such a way, the efficiency of the heat transfer is enhanced, since substantially the whole heat exchanger surface of the heat exchanger plates is utilised.

According to an embodiment of the invention, the distribution element is formed through a shaping of the heat exchanger plate, wherein this shaping forms a projection extending into the adjacent second plate interspace and a depression extending from the adjacent first plate interspace. The projection will thus prolong the flow path of the fluid through the plate package and distribute the fluid over a larger surface. The depression will have a positive distributing effect on the medium. Due to the volume created in the plate package, medium will be collected in the depression and therefrom be distributed through the different passages towards the outlet channels in the upper portion of the plate package. By letting the distribution element and depression have an arrow-like shape pointing upwardly, the medium, which is collected in the depression, will be guided towards the centre. Such a shaping of the distribution element may be easily done in connection with the compression moulding of the heat exchanger plate.

According to another embodiment of the invention, the distribution element is formed by a rod-like insert which is provided in the second plate interspace. Such an insert may in an easy manner be provided in the second plate interspace in connection with the manufacturing of the plate package. The insert may then suitably be attached to one or both of the adjacent plates by means of any suitable method such as brazing, welding or gluing. The insert may be manufactured of any suitable material, for instance a metal, such as stainless steel or titanium, plastics, ceramic materials etc. An advantage of such a separate insert is that it easily may be adapted to various applications, for instance the horizontal length of the inset may be varied in an easy manner.

According to a further embodiment of the invention, the plate package includes, in addition to said upper portion, a lower portion and an intermediate portion, wherein the first portholes are provided in the proximity of the lower portion and the second portholes in proximity of the upper portion. By such a layout, the plate package will operate according to the principle of parallel flow. It is to be noted that it is also possible to let the first portholes be provided in the proximity of the upper portion and the second portholes in the proximity of the lower portion, wherein the plate package operates according to the principle of counter flow. Furthermore, said portions may include a respective corrugation of ridges and valleys, wherein the corrugation of the intermediate portion extends in at least one direction of one of said plates and in at least another direction of an adjacent plate in such a way that the corrugations of adjacent plates cross each other in the intermediate portion. In such a way, a high strength of plate package is achieved at the same time as an effective heat transfer between the fluid and the medium is ensured.

According to a further embodiment of the invention, the sectional plane intersects the first porthole and the second porthole. The two portholes thus lie at a substantially vertical line which is substantially perpendicular to the extension of the elongated distribution element. Advantageously, the distribution element is provided substantially in the middle between the first porthole and the second porthole.

According to a further embodiment of the invention, each heat exchanger plate has an upper edge, a lower edge and two side edges, wherein the distribution element is located substantially in the middle between the upper edge and the lower edge and in the middle between the two side edges. Advantageously, the distribution element may then have such a length that the closest distance to each of the side edges is equal to 0.7 to 1.0 * the distance to the upper edge. By such a length a flow cross section between the distribution element and the respective side edge, which may result in a certain throttling, is achieved, and in such a way turbulence of the fluid is obtained.

According to a further embodiment of the invention, the distribution element has an intermediate portion and two outer portions which extend from the intermediate portion to a respective side edge. Advantageously, at least one of the outer portions may then have an inclination upwardly towards the upper edge.

According to a further embodiment of the invention, the distribution element includes at least one interruption forming a passage for said fluid through the distribution element.

According to a further embodiment of the invention, the upper part space is designed in such a way that said outlet channels extend in such a direction that the medium is guided outwardly from a central part of the plate package. The plate package according to the invention may thus constitute a compact and efficient evaporator, for instance in a cooling plant. More specifically, said outlet portions may extend obliquely upwardly and outwardly from said sectional plane. In such a way it is insured that the gaseous medium hits the inner wall surface where possible remaining liquid will be collected. Said outlet portions may advantageously then extend at an angle which is 30 to 60° in relation to said sectional plane. More specifically, said angle may be about 45°.

According to a further embodiment of the invention, the plate package has an upper side, a lower side and two opposite transverse sides, and is provided in such a way in the inner space that the plate package, substantially, is located in the lower part space and that gap-like recirculation channels are formed between the inner wall surface and the respective transverse side. Advantageously, said first interspaces are closed towards the inner space along the transverse sides, which extend between and connect the lower side and the upper side.

BRIEF DESCRIPTION OF THE DRAWINGS

The present invention is now to be explained more closely through a description of various embodiments and with reference to the drawings attached hereto.

DETAILED DESCRIPTION OF VARIOUS EMBODIMENTS OF THE INVENTION

Figure 1:
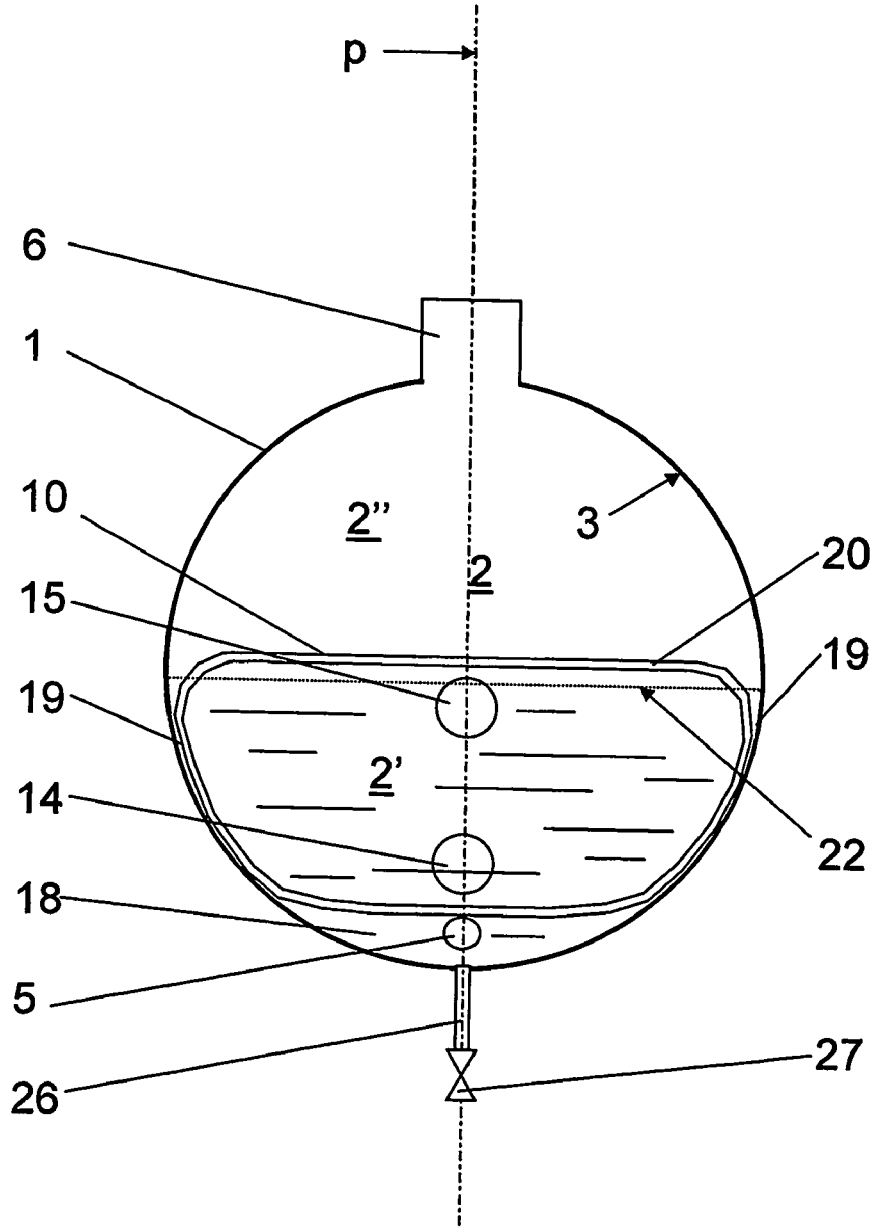
FIG. 1 discloses a schematical and sectional view from the side of a heat exchanger device according to an embodiment of the invention.
Figure 2:
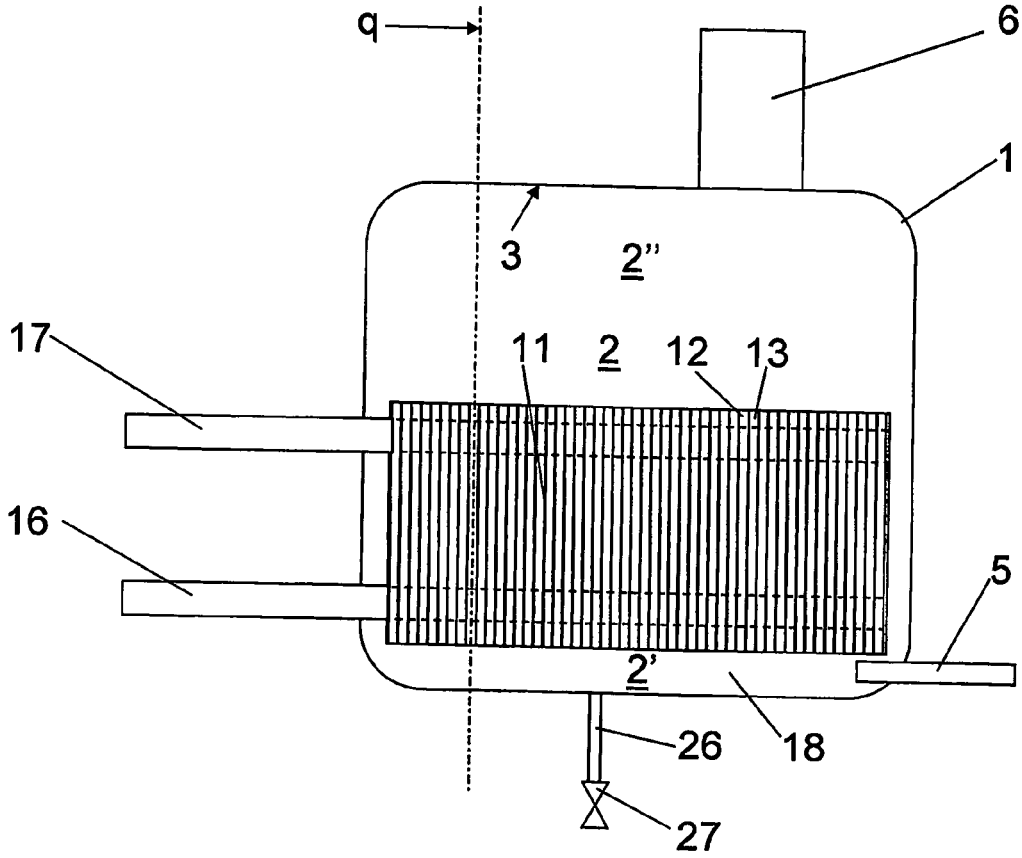
FIG. 2 discloses schematically another sectional view of the heat exchanger device in FIG. 1.

Referring to FIGS. 1 and 2, a heat exchanger device according to the invention is disclosed. The heat exchanger device includes a tank 1, which forms a substantially closed inner space 2. In the embodiment disclosed the tank 1 has a substantially cylindrical shape with a substantially cylindrical shell wall, see FIG. 1, and two substantially plane end walls. The end walls may also have a semi-spherical shape, for instance. Also other shapes of the tank 1 are possible. The shell wall of the tank 1 forms a substantially cylindrical inner wall surface 3 facing the inner space 2. Through the tank 1 and the inner space 2, a sectional plane p extends. The tank 1 is arranged to be provided in such a way that the sectional plane p is substantially vertical.

The tank 1 also includes an inlet 5 for the supply of a medium in a liquid state to the inner space 2, and an outlet 6 for the discharge of the medium in a gaseous state from the inner space 2. The inlet 5 includes an inlet conduit which ends in a lower part space 2' of the inner space 2. The outlet 6 includes an outlet conduit 6, which extends from an upper part space 2" of the inner space 2.

The heat exchanger device also includes a plate package 10, which is provided in the inner space 2 and includes a plurality of heat exchanger plates 11 that are provided adjacent to each other. Such a heat exchanger plate 11 is disclosed more closely in FIG. 3. The heat exchanger plates 11 are permanently connected to each other in the plate package 10, for instance through welding, brazing or gluing. The heat exchanger plates 11 are preferably manufactured in a corrosion resistant material, for instance stainless steel or titanium.

Each heat exchanger plate 11 has a main extension plane q and is provided in such a way in the plate package 10 and the tank 1 that the extension plane q is substantially vertical and substantially perpendicular to the sectional plane p. The sectional plane p also extends transversally through each heat exchanger plate 11, and in the embodiment is disclosed, the sectional plane p also thus forms a vertical centre plane through each individual heat exchanger plate 11.

The heat exchanger plates 11 form in the plate package 10 first interspaces 12, which are open towards inner space 2, and second plate interspaces 13, which are closed towards the inner space 2. The medium mentioned above, which is supplied to the tank 1 via the inlet 5, thus pass into the plate package 10 and in particular into the first plate interspaces 12.

Each heat exchanger plate 11 includes a first porthole 14 and a second porthole 15. The first portholes 14 form an inlet channel connected to an inlet conduit 16. The second portholes 15 form an outlet channel connected to an outlet conduit 17. The sectional plane p extends through both the first porthole 14 and second porthole 15. The heat exchanger plates 11 are connected to each other around the portholes 14 and 15 in such a way that the inlet channel and the outlet channel are closed in relation to the first plate interspaces 12 but open in relation to the second plate interspaces 13. A fluid may thus be supplied to the second plate interspaces 13 via the inlet conduit 16 and the associated inlet channel formed by the first portholes 14, and discharged from the second plate interspaces 13 via the outlet channel formed by the second portholes 14 and the outlet conduit 17.

As is shown in FIG. 1, the plate package 10 has an upper side and a lower side, and two opposite transverse sides. The plate package 10 is provided in the inner space 2 in such a way that it substantially is located in the lower part space 2' and that a collection space 18 is formed beneath the plate package 10 between the lower side and the inner wall surface 3. Furthermore, gap-like recirculation channels 19 are formed at each side of the plate package 10 between the inner wall surface 3 and the respective transverse side. It is to be noted here that each heat exchanger plate 11 includes an edge area 20, which extends around substantially the whole heat exchanger plate 11 and which permits said permanent connection of the heat exchanger plates 11 to each other. These edge areas 20 will along the transverse sides abut the inner cylindrical wall surface 3, and said recirculation channels 19 are formed by gaps extending along the transverse sides between each pair of heat exchanger plates 11. It is also to be noted that the heat exchanger plates 11 are connected to each other in such a way that the first plate interspaces 12 are closed along the transverse sides, i.e. towards the recirculation channels 19 of the inner space 3.

The embodiment of the heat exchanger device disclosed in this application may be used for evaporating a medium supplied in a liquid state via the inlet 5 and discharged in a gaseous state via the outlet 6. The heat necessary for the evaporation is supplied by the plate package 10, which via the inlet conduit 16 is fed with a fluid for instance water that is circulated through the second plate interspaces 13 and discharged via the outlet conduit 17. The medium, which is evaporated, thus is at least partly present in a liquid state in the inner space 2. The liquid level may extend to the level 22 indicated in FIG. 1. Consequently, substantially the whole lower part space 2' is filled by medium in a liquid state, whereas the upper part space 2" contains the medium in mainly the gaseous state.

Figure 3:
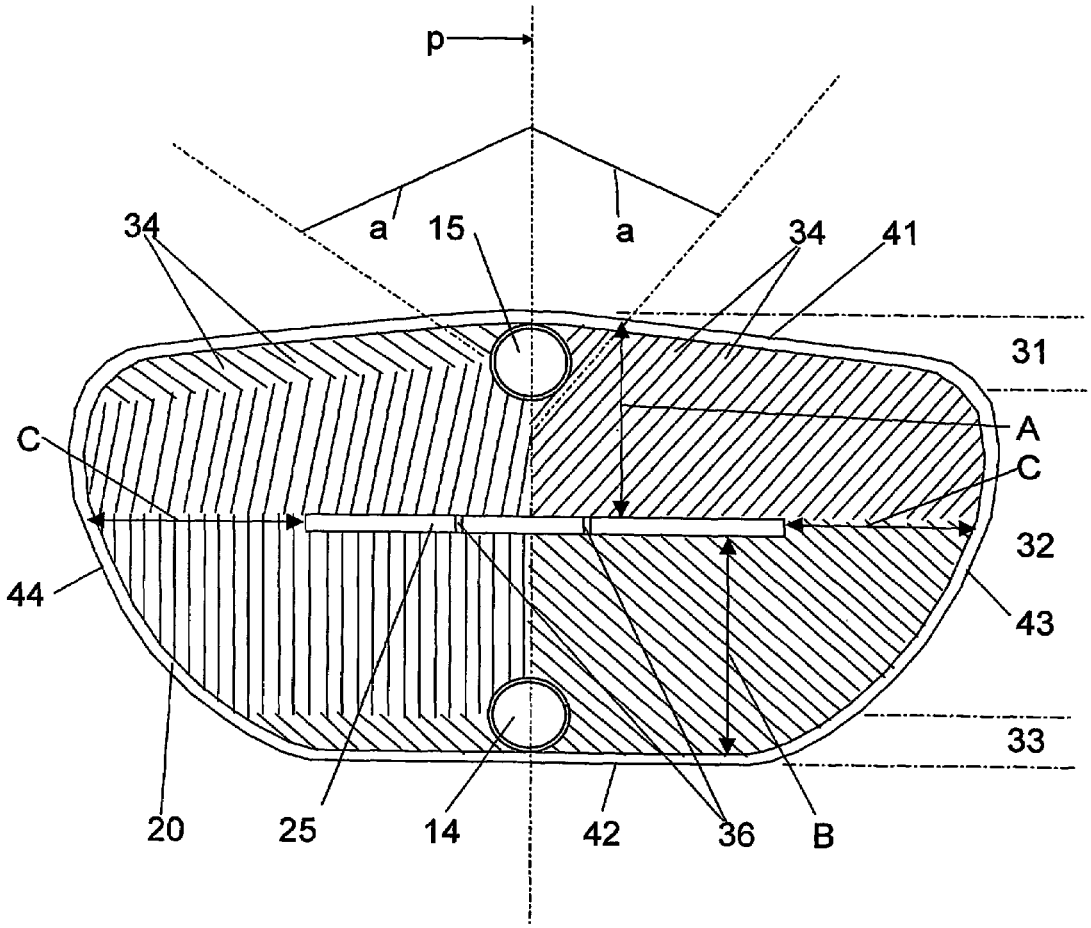
FIG. 3 discloses schematically a plan view of a heat exchanger plate of a plate package of the heat exchanger device in FIG. 1.

In FIG. 3, an embodiment of a heat exchanger plate 11 in the plate package 10 is disclosed more closely. It is to be noted that all heat exchanger plates 11 in the plate package 10 advantageously have the same shape and appearance. In the complete plate package 10, every second plate is turned in the manner disclosed in FIG. 3, whereas every other plate is rotated 180° about a substantially vertical rotary axes coinciding with the sectional plane p. The plate package 10 and each heat exchanger plate 11 include tree portions, see FIG. 3, an upper portion 31, an intermediate portion 32 and a lower portion 33. Each portion includes a corrugation of ridges and valleys, wherein the actual heat exchange between the heat exchanger plates 11 takes place via the intermediate and lower portions 32, 33. The corrugation in the intermediate portion 32 extends as is shown in FIG. 3, in different directions at different parts of the intermediate portion 32. The corrugations are made in such a way that the corrugation in all parts of the intermediate portion 32 extends in a respective direction of one plate 11, and in another respective direction of an adjacent plate 11 in such a way that the corrugations of adjacent plates 11 cross each other over the whole intermediate portion 32. In such a way, an efficient heat transfer from the fluid to the medium is ensured at the same time as the plates 11 included in the plate package 10 are given the required mechanical support.

As is shown in FIG. 3, the first portholes 14 are provided in the proximity of the lower portion 33 and the second portholes 15 in the proximity of the upper portion 31, wherein the fluid will flow upwardly through the second plate interspaces 13 in the plate package. Of course it is also possible to provide the first portholes 14 at the upper portion and the second portholes at the lower portion 33. It is also possible to provide the portholes 13 and 14 in other positions on the plate 11.

As is shown in FIG. 3, the corrugation extends in the upper portion 31 obliquely outwardly from the sectional plane p forming a middle plane of each heat exchanger plate 11. The corrugations extend at an angle a, which is about 45° in the embodiment disclosed. This means that when the heat exchanger plates 11 are provided adjacent to each other in the plate package 10 the corrugations in the upper portion 31 will form outlet channels in the first plate interspaces 12. These outlet channels are formed by valleys between adjacent ridges of the corrugations and have been given the reference sign 34. The outlet channels 34 will thus extend obliquely upwardly and outwardly from the sectional plane p at the same angle a as the corrugations. This angle may be from 30 to 60° and advantageously about 45° as is shown in the embodiment disclosed.

Since the plate package 10 is provided in the lower part space 2' and since the liquid level 22 lies below the upper side of the plate package 10, the medium, which flows upwardly through the plate package 10 in the first plate interspaces 12, will be guided by the outlet channels 34 obliquely outwardly towards the inner wall surface 3. The inner wall surface 3 will then catch possibly remaining liquid from the mainly gaseous medium in the upper part space 2'. The caught liquid may then flow along the inner wall surface 3 and down into the recirculation channels 19 back to the lower part space 2' where the medium is present in the liquid state. Since also the first plate interspaces 12 are closed along the transverse sides of the plate package 10 the recirculated liquid will flow down to be collected in the collection space 18. From there the liquid medium may again flow into and up through the first plate interspaces 12 of the plate package 10. The collection space 18 then operates as a distribution chamber distributing the medium uniformly to different parts of the plate package 10.

As is shown in FIG. 3, the corrugation of the intermediate portion 32 of each heat exchanger plate 11 includes an elongated distribution element 25, which extends substantially perpendicularly in relation to the sectional plane p and the vertical extension plane q of the plate 11. The elongated distribution element 25 projects into the adjacent second plate interspace 13 and meets a corresponding distribution element 25 of an adjacent heat exchanger plate 11 in such a way that the two distribution elements 25 provides a flow barrier in the second plate interspace 13. This means that the fluid is forced to take a prolonged path through the second plate interspace 13 and may not flow straight between the portholes 13, 14. Possibly, the distribution element 25 may be provided with one, two, three, four or more shorter interruptions 36, in such a way that a smaller part of the fluid may pass the barrier formed by the distribution elements 25 for a better utilisation of the heat exchanging capacity of the parts of the plates 11 which are located immediately above and below the barrier. Two such interruptions 36 are disclosed in FIG. 3.

The elongated distribution element 25, which is disclosed in FIG. 3, is formed through a compression-moulding of the heat exchanger plate 11, preferably at the same time as the compression-moulding of the plate 11. By such a compression-moulding a projection, which extends as a ridge into the adjacent second plate interspace 13, is formed at one side of the plate 11, and at the other side of the plate 11 a depression that extends as a valley from the adjacent first plate interspace 12 is formed.

The distribution element 25 disclosed is provided in the intermediate portion 32 and in particular substantially in the middle between he first porthole and the second porthole. Each heat exchanger plate 11 has an upper edge 41, a lower edge 42 and two side edges 43, 44. The distribution element 25 is located substantially in the middle between the upper edge 41 and the lower edge 42, and in the middle between the two side edges 43 and 44. The distance from the distribution element 25 to the upper edge 41 has been designated by A. The distance from the distribution element 25 to the lower edge 42 has been designated with B. The distance from the distribution element 25 to the respective side edge 43, 44 has been designated with C. A and B may be different but are in the embodiment disclosed substantially equal. The distribution element 25 has such a length that the closest distance C from the outer ends of the distribution element 25 to the respective side edge 43, 44 is equal to 0.7 to 1.0 multiplied by the distance A to the upper edge 41.

Figure 4:
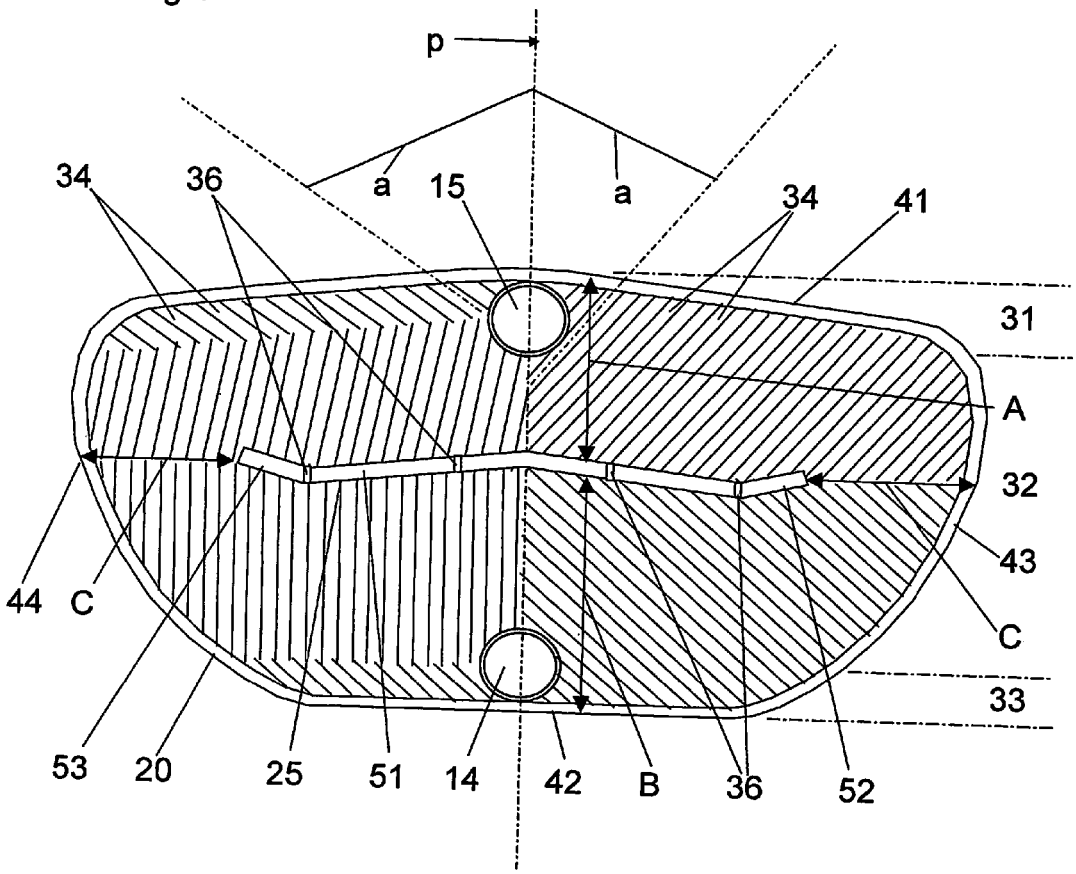
FIG. 4 discloses schematically a plan view of another heat exchanger plate of a plate package of the heat exchanger device in FIG. 1.

FIG. 4 discloses a variant of the heat exchanger plate 11, which differs from the heat exchanger plate 11 disclosed in FIG. 3 through the design of the distribution element 25. In the heat exchanger plate 11 in FIG. 4, the distribution element 25 has an intermediate portion 51 and two outer portions 52, 53, which extend from the intermediate portion 51 towards a respective side edge 43, 44. The both outer portions 52, 53 have a small inclination upwardly towards the upper edge 41 of the heat exchanger plate 11. The intermediate portion 51 has an arrow-like shape and slopes from the two outer portions 52 and 53, respectively, upwardly towards the upper edge 41. The distribution element 25 in FIG. 4 is provided with four interruptions 36.

Figure 5:
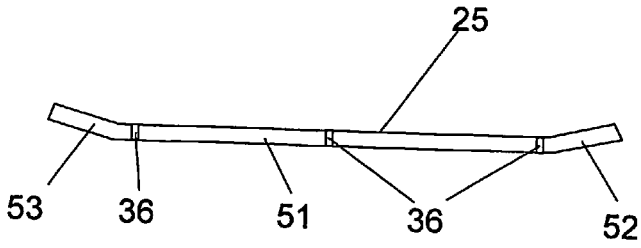
FIG. 5 discloses a distribution element for a plate package of the heat exchanger device.

FIG. 5 discloses a distribution element 25 as a separate elongated rod-like insert intended to be located in the second plate interspace 13. This insert may in an easy manner be provided in the second plate interspaces 13 in connection with the manufacturing of the plate package 10. The insert may then suitably be attached to one or both of the adjacent heat exchanger plates 11, for instance by brazing, welding or gluing. The inset may be manufactured of any suitable material, for instance a metal, such as stainless steel or titanium, plastics, ceramic materials etc. The distribution element 25 disclosed has two upwardly sloping outer portions 52 and 53 and a substantially straight intermediate portion 51. The distribution element 25 has three interruptions 36. It is to be noted that the interruptions 36 may be designed as holes through the insert or as recesses extending from the upper side or lower side of the insert.

The heat exchanger device also includes a discharge conduit 26 extending from the collection space 18 at the lowest located point of the tank 1. The discharge conduit 26 includes a valve 27 enabling intermittent discharge of impurities that has been collected in the bottom area of the collection space 18, for instance oils or alike.

The invention is not limited to the above-limited embodiment but may be varied and modified within the scope of the following claims.

What is claimed is:

1. A plate package (10) for a heat exchanger device having a tank (1), which forms a substantially closed inner space (2) and which includes an inner wall surface (3) facing the inner space, wherein the tank (1) is arranged to be provided in such a way that a sectional plane (p), which extends through the plate package (10) and the inner space of the tank (1), is substantially vertical, wherein the plate package (10) is arranged to be provided in the inner space (2) and comprises heat exchanger plates (11) provided adjacent to each other, wherein each heat exchanger plate (11) has a main extension plane (q) and is provided in such a way that the extension plane (q) is substantially perpendicular to said sectional plane (p), wherein the heat exchanger plates (11) form first plate interspaces (12), which are substantially open to the inner space (2) and arranged to permit circulation of said medium from the lower part space (2') upwardly to the upper part space (2"), and second plate interspaces (13), which are closed to the inner space (2) and arranged to permit recirculation of a fluid for evaporating the medium, wherein the first plate interspaces (12) in an upper portion (31) of the plate package (10) form outlet channels (34) for the medium, wherein each heat exchanger plate (11) includes a first porthole and a second porthole (15) and wherein the first portholes (14) form an inlet channel for said fluid to the second plate interspaces (12) and the second portholes (15) form an outlet channel for said fluid from the second plate interspaces (13), and wherein each heat exchanger plate includes an elongated distribution element (25) extending into the adjacent second plate interspace (13) and substantially transversally to said sectional plane (p).

2. A plate package according to claim 1, wherein the distribution element (25) is formed through a shaping of the heat exchanger plate (11), wherein this shaping forms a projection extending into the adjacent second plate interspace (13) and a depression extending from the adjacent first plate interspace (12).

3. A plate heat exchanger according to claim 1, wherein the distribution element (25) is formed by a rod-like insert which is provided in the second plate interspace (13).

4. A plate package according to claim 1, wherein the plate package in addition to said upper portion (31) includes a lower portion (33) and an intermediate portion (32), wherein the first portholes (14) are provided in the proximity of the lower portion (33) and the second portholes (15) in the proximity of the upper portion (31).

5. A plate package according to claim 4, wherein the portions (31-33) include a respective corrugation of the ridges and valleys, and wherein the corrugation of the intermediate portion (32) extends in at least one direction of one of said plates and in at least another direction of an adjacent plate (11) in such a way that the corrugations of adjacent plates (11) cross each other in the intermediate portion (32).

6. A plate package according to claim 1, wherein the sectional plane (p) intersects the first porthole (14) and the second porthole (15).

7. A plate package according to claim 1, wherein the distribution element (25) is provided substantially in the middle between the first porthole (14) and the second porthole (15).

8. A plate package according to claim 7, wherein the distribution element (25) has an intermediate portion (51) and two outer portions (52,53) which extend from the intermediate portion (51) to a respective side edge (43,44).

9. A plate package according to claim 8, wherein at least one of the outer portions (52,53) has an inclination upwardly towards the upper edge (41).

10. A plate package according to claim 8, wherein the intermediate portion (51) from the two outer portions (52,53) is inclined upwardly towards the upper edge (41).

11. A plate package according to claim 1, wherein each heat exchanger plate has an upper edge (41), a lower edge (42) and two side edges (43,44), wherein the distribution element (25) is located substantially in the middle between the upper edge (41) and the lower edge (42), and in the middle between the two side edges (43,44).

12. A plate package according to claim 11, wherein the distribution element (25) has such a length that the closest distance (C) to each of the side edges (43,44) is equal to 0.7 to 1.0 multiplied by the distance (A) to the upper edge (41).

13. A plate package according to claim 1, wherein the distribution element (25) includes at least one interruption (36) forming a passage for said fluid through the distribution element (25).

14. A plate package according to claim 1, wherein the upper part space (2") is designed in such a way that said outlet channels (34) extend in such a direction that the medium is guided outwardly from a central part of the plate package.

15. A plate package according to claim 1, wherein said outlet channel (34) extends obliquely upwardly and outwardly from said sectional plane.

16. A plate package according to claim 15, wherein said outlet channels (34) extend at an angle (a) that is 30 to 60° in relation to said sectional plane.

17. A plate package according to claim 16, wherein said angle (a) is about 45°.

18. A plate package according to claim 1, wherein the plate package (10) has an upper side, a lower side and two opposite transverse sides, and is provided in such a way in the inner space (2) that the plate package, substantially, is located in the lower part space (2') and that gap-like recirculation channels (19) are formed between the inner wall surface and the respective transverse side.

* * * * *